US007107915B2

(12) United States Patent
Laws et al.

(10) Patent No.: US 7,107,915 B2
(45) **Date of Patent: *Sep. 19, 2006**

(54) LOCKING MECHANISM FOR FOLDING LEGS

(75) Inventors: David J. Laws, Provo, UT (US); Dale Spendlove, Orem, UT (US); Richard D. Smith, Springville, UT (US); Phillip J. Swindler, Provo, UT (US)

(73) Assignee: Mity-Lite, Inc., Orem, UT (US)

( * ) Notice: Subject to any disclaimer, the term of this patent is extended or adjusted under 35 U.S.C. 154(b) by 366 days.

This patent is subject to a terminal disclaimer.

(21) Appl. No.: 10/629,440

(22) Filed: Jul. 28, 2003

(65) Prior Publication Data

US 2005/0247243 A1 Nov. 10, 2005

Related U.S. Application Data

(63) Continuation-in-part of application No. 09/859,919, filed on May 17, 2001, now Pat. No. 6,598,544.

(51) Int. Cl.
*A47B 3/00* (2006.01)

(52) U.S. Cl. ..... 108/131; 108/130; 108/132; 248/436

(58) Field of Classification Search ..... 108/131, 108/132, 133, 129, 127, 125; 248/439, 188.6, 248/188.1, 188, 436, 292.12; 403/93, 97, 403/92, 94, 103

See application file for complete search history.

(56) References Cited

U.S. PATENT DOCUMENTS 3,419,295 A 12/1968 Small
3,730,465 A * 5/1973 Gonzalez ..... 248/188.6
3,844,517 A 10/1974 Fraser
4,064,815 A * 12/1977 Baum ..... 108/129
4,383,486 A 5/1983 Reineman et al.
4,407,479 A 10/1983 Combe
4,561,622 A 12/1985 Heinzel
4,617,869 A 10/1986 Denomey
4,747,569 A 5/1988 Hoshino
4,830,250 A 5/1989 Newbold et al.
5,056,699 A 10/1991 Newbold et al.
5,062,179 A 11/1991 Huang
5,211,323 A 5/1993 Chimenti et al.
5,213,004 A 5/1993 Hoblingre
5,265,969 A 11/1993 Chuang
5,323,713 A 6/1994 Luyk et al.
5,367,815 A 11/1994 Liou
5,413,015 A 5/1995 Zentmyer
5,520,474 A 5/1996 Liu
5,845,589 A 12/1998 Pfister
5,964,443 A 10/1999 Leveille
6,598,544 B1 * 7/2003 Laws et al. ..... 108/131

* cited by examiner

*Primary Examiner*—Jose V. Chen
(74) *Attorney, Agent, or Firm*—Thorpe North & Western

(57) ABSTRACT

A locking mechanism for a support leg hingedly attached to a support surface includes a base, attached to the support surface, with a plurality of angularly spaced, radial teeth, and a coupler, attached to the support leg, having a plurality of angularly spaced, radial teeth configured to mate with the teeth of the base. A selectively releasable engagement mechanism is configured to engage and disengage the teeth of the base with the teeth of the coupler, to allow selective rotation of the support leg between an extended position and a folded position, and to lock the leg in the extended or folded position.

22 Claims, 13 Drawing Sheets

LOCKING MECHANISM FOR FOLDING LEGS

This application is a continuation-in-part of U.S. patent application Ser. No. 09/859,919 filed on May 17, 2001 entitled LOCKING MECHANISM FOR FOLDING LEGS, now U.S. Pat. No. 6,598,544 which issued on Jul. 29, 2003.

BACKGROUND OF THE INVENTION

1. Field of the Invention

This invention relates to foldable support legs for tables, chairs, portable staging, risers, or other similar portable equipment requiring foldable legs for supporting a surface. More particularly, the present invention relates to an improved locking mechanism for folding legs which is simpler and stronger than other similar mechanisms.

2. Related Art

Portable tables, chairs, risers, etc. having foldable legs are well known. Such devices typically comprise a support surface of some kind having a plurality of support legs hingedly attached to the underside. The legs are rotatable from a folded position against the underside of the support surface, to an extended position where they are generally perpendicular to the support surface. When in the extended position, the support legs are typically locked into place by means of a lock arm, a catch, a linkage, or some other similar locking mechanism. The most common of these mechanisms typically involve hinged angular supports and sliding collars, or spring loaded catches.

To be functional and safe, these locking mechanisms must hold the legs firmly in place, without wobbling or twisting. However, they must be easy to lock and unlock, particularly for novices who are unfamiliar with the mechanism. Accordingly, it is preferable that such devices be lightweight, simple, and intuitive to use. Unfortunately, some prior leg locking mechanisms have relatively low strength, and are susceptible to failure. For example, hinged angular supports can easily buckle if a locking collar is not properly placed, possibly resulting in collapse of the legs and the support surface. Some prior leg locking mechanism can also be in the way of one's knees when sitting at the table. Others are complicated, expensive, and sometimes not very durable. Many of them are also quite heavy, and noisy, thus reducing the desirability, portability, and practicality of the support device.

SUMMARY OF THE INVENTION

It has been recognized that it would be advantageous to develop a locking mechanism for folding legs which is strong and durable, simple in construction and operation, and is relatively lightweight.

It has also been recognized that it would be advantageous to provide a locking mechanism for folding legs which eliminates or reduces potential hazards to one's knees, and which also provides for a wide range of leg styles.

The invention advantageously provides a locking mechanism for a support leg hingedly attached to a support surface. The locking mechanism includes a base, attached to the support surface, with a plurality of angularly spaced, radial teeth, and a coupler, attached to the support leg, having a plurality of angularly spaced, radial teeth configured to mate with the teeth of the base. A selectively releasable engagement mechanism is configured to engage and disengage the teeth of the base with the teeth of the coupler to allow selective rotation of the support leg from an extended position to a folded position, and to lock the leg in place in the folded and the extended position.

In accordance with a more detailed aspect of the present invention, the locking mechanism may include a pair of oppositely oriented bases attached to the support surface, each having a support leg connected thereto, and the pair of support legs being mechanically connected, the selectively releasable engagement mechanism further comprising an oppositely directed spring force built into each of the connected pair of legs, such that the natural position of the legs provides force to engage the teeth. A flexible tension member may be provided for countering the force of the engaging means to allow the tops of the legs to be drawn together, thus drawing the teeth out of engagement, allowing the legs to be rotated from the extended position to the folded position, and vice versa.

In accordance with another more detailed aspect of the present invention, the selectively releasable engagement mechanism may further comprise a biasing spring configured for biasing the counter-locking side of the coupler away from the locking side of the base, and a cam associated with the coupler, configured for creating a biasing force for biasing the counter-locking side of the coupler toward the locking side of the base, the biasing force of the cam being greater than the biasing force of the biasing spring. A release is associated with the cam, configured to release at least part of the biasing force of the cam, to allow the biasing spring to disengage the teeth of the base and the coupler, and allow rotation of the support leg when the release is actuated by a user.

Additional features and advantages of the invention will be apparent from the detailed description which follows, taken in conjunction with the accompanying drawings, which together illustrate, by way of example, features of the invention.

DETAILED DESCRIPTION

Figure 1A:
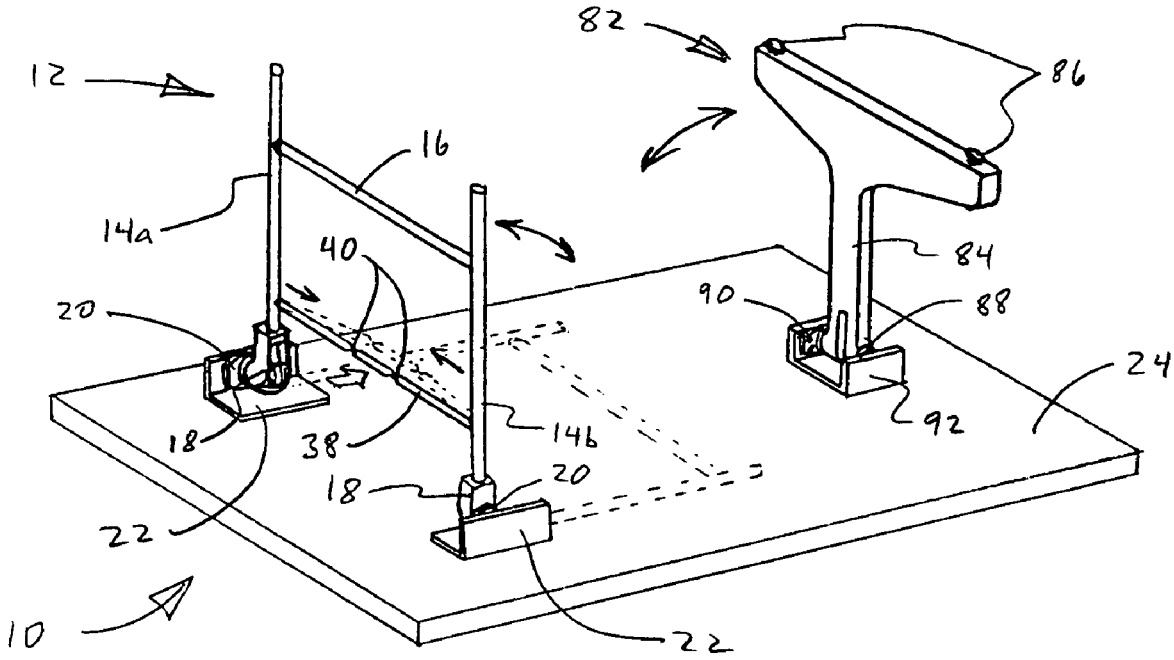
FIG. 1A is an underside pictorial view of a table provided with a leg locking mechanism according to the present invention, showing two different configurations for connecting the table legs, and wherein the selectively releasable engagement mechanism for the dual leg configuration includes a buckling rod deflecting mechanism.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Viewing FIG. 1A, the invention is shown in use with a table 10, which is shown inverted for clarity. It will be apparent that the present invention is suitable for use with a wide variety of items other than tables, such as chairs, portable stage platforms, risers, and any other support surface requiring foldable support legs. The table 10 typically has a leg assembly 12 comprising two legs 14*a* and 14*b* rigidly connected by a crossbar 16. The top end of each leg 14*a* and 14*b* includes a coupler 18, which is joined to a base 20, which in turn is affixed to an angle bracket 22, which is securely affixed to the underside 24 of the table 10. Alternatively, the base may be affixed to a table runner (see, e.g., 174 in FIG. 6), which may be integral with the table top, or may comprise a separate element attached to the table. The couplers 18 and bases 20 together form a rotary coupler which is configured to lock together only at desired angular orientations, preferably including an extended position wherein the legs extend generally perpendicularly from the underside of the table, as shown, and a folded position wherein the legs are parallel to the underside 24 of the table 10 (shown in dashed lines in FIG. 1A). It will be apparent that the base 20 and angle bracket 22 may be configured as a single unit, thus allowing the rotary coupler to be directly affixed to the underside of the table.

Figure 2:
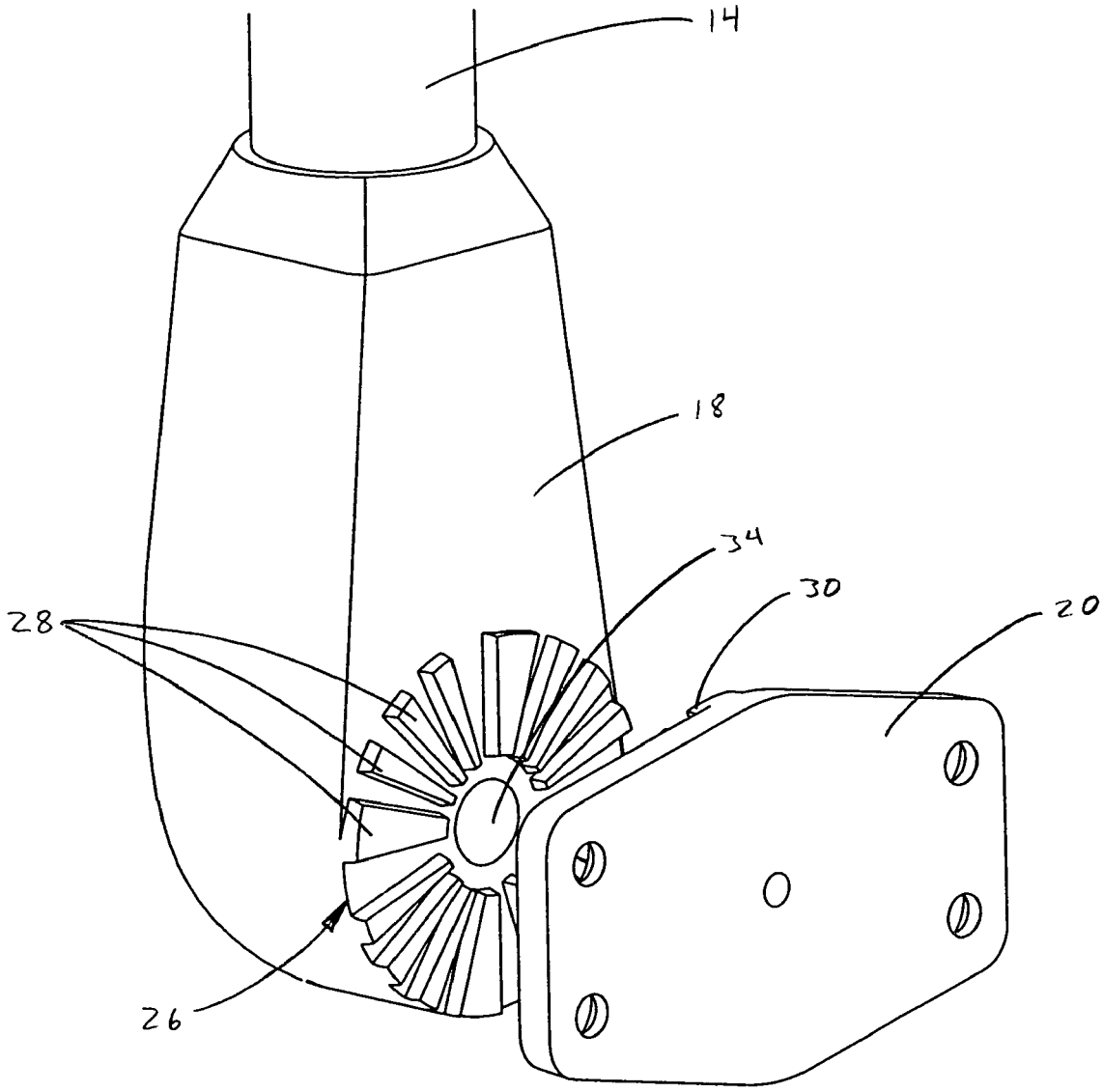
FIG. 2 is a pictorial view of a rotary coupler and base according to the present invention, showing the angularly spaced, radial teeth of the coupler.
Figure 3:
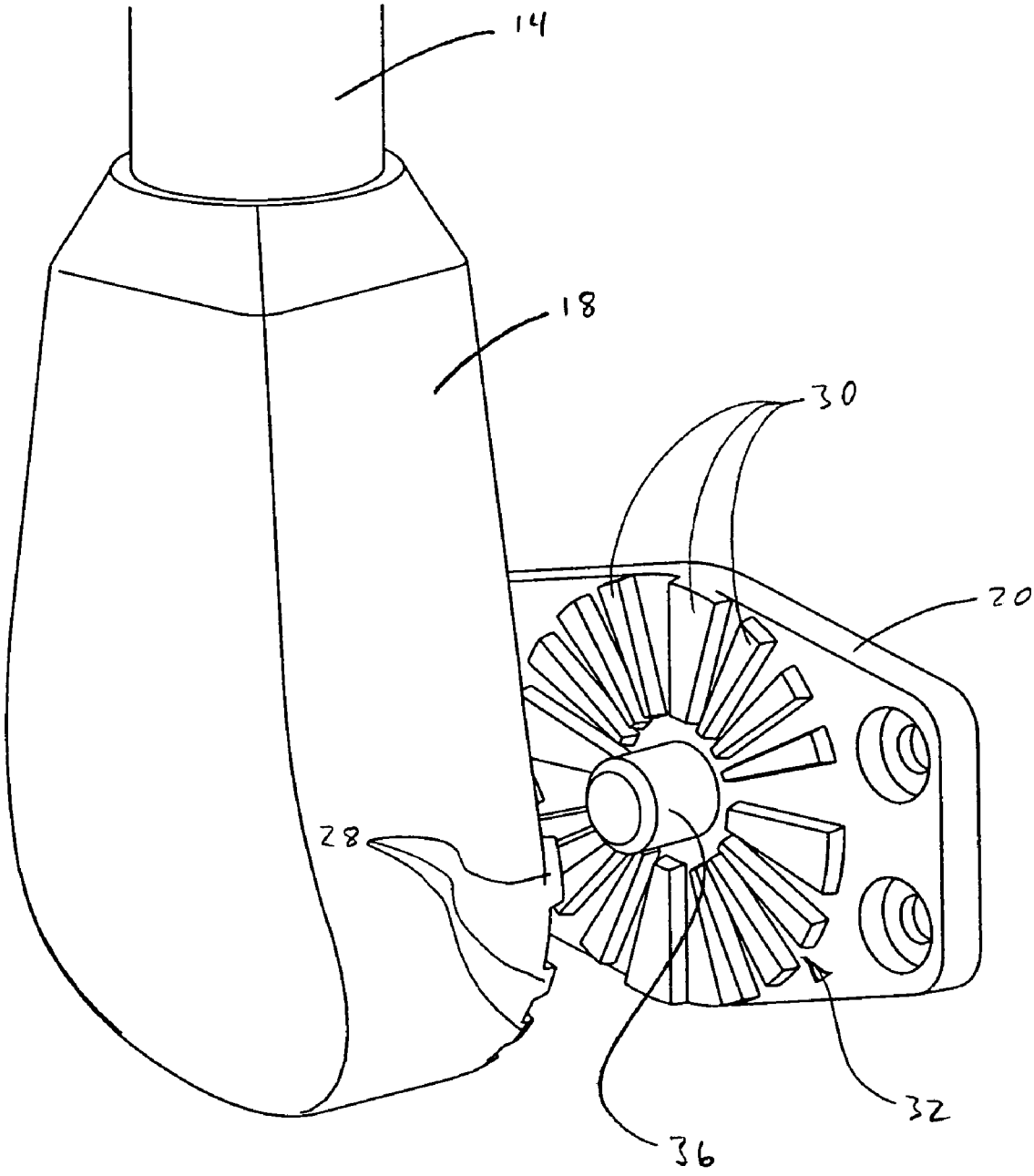
FIG. 3 is an alternative pictorial view of the rotary coupler and base of FIG. 2, showing the angularly spaced, radial teeth of the base.

Referring to FIGS. 2 and 3, the coupler 18 comprises a circular face 26 which is oriented generally perpendicularly to the long axis of the leg 14, and includes a plurality of radial teeth 28 comprising a series of ridges and valleys. The teeth 28 have flattened top surfaces, are preferably non-uniform in width, and are designed to mate with a set of radial teeth 30, comprising a series of ridges and valleys having an oppositely corresponding mating configuration to the teeth 28, which are formed on a circular face 32 of the base 20. The coupler 18 and base 20 are preferably formed of glass-filled injection molded plastic. This material is inexpensive, and lends itself well to large scale production. It also has a high strength-to-weight ratio and allows close control of tolerances during manufacture.

A circular hole 34 is provided in the coupler 18 at the center of the circular face 26, and a corresponding shaft 36 extends from the center of the circular face 32 of the base 20 to provide a rotational axle for the opposing faces 26 and 32. A biasing means is disposed around the shaft 36 between the circular faces, and is configured to push the coupler and base away from each other. This biasing means may comprise a spring washer (similar to spring washer 108 shown in FIG. 9*a*), a coil spring, or other comparable device suitable for pushing the faces apart.

The teeth 28 and 30 are flat-topped and non-uniform in width so that the coupler 18 and base 20 will lock together only at desired angular orientations, as mentioned above. FIG. 4*a* shows the coupler and base with teeth interlocked. When it is desired to extend or retract the table legs, the teeth of the coupler and base are disengaged from each other so that the flat tops of the teeth may slide smoothly over each other as the coupler is rotated with respect to the base. An engaging means, described in more detail below, is provided to keep the coupler normally engaged with the base. When the engaging means is released, the biasing means disposed around the shaft 36 pushes the two circular faces 26 and 32 apart, allowing them to rotate. When the next proper angular orientation is reached, the teeth will naturally slide into place and lock with each other by virtue of the engaging force (which is greater than the force of the biasing means) provided by the engaging means.

Because the teeth 28 and 30 are non-uniform in width, they will engage only when appropriately sized valleys are disposed opposite appropriately sized ridges around the entire circular face. For example, in the embodiments shown in the drawings, there are two sizes of teeth. When rotating, the larger (wider) teeth ride on the flat tops of the smaller (narrower) teeth until the large teeth become disposed opposite large valleys which allow them to slide into locking position. The different sized teeth in conjunction with the flat tops are what allow smooth rotation between locking positions. Without different tooth sizes, the mechanism only rotates to the next tooth before locking again. With such a configuration proper functioning of the mechanism could be provided using a smaller number of uniform teeth with slots disposed only at positions corresponding to desired locking locations. However, larger numbers of teeth are desired to provide a larger interlocking surface area, and thus increased interlocking strength. It will be apparent that when engaged, the rotational strength of the rotary coupler is dependent in part upon the number of teeth which are interlocked. A larger number of uniform teeth would provide a strong connection, while also creating an interlocking position at each tooth. With non-uniform teeth, a few interlocking positions are possible while still providing many teeth which interlock, making the mechanism stronger.

Figure 4B:
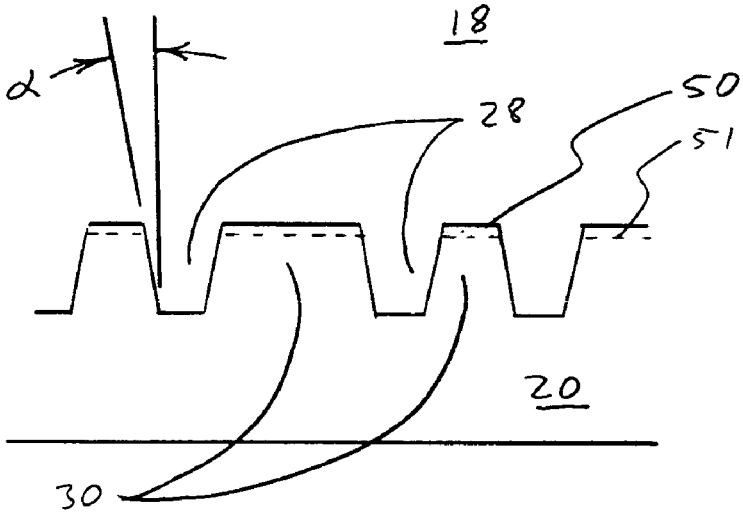
FIG. 4*b* is a close-up, cross-sectional view of the interlocked teeth of FIG. 4*a*.
Figure 4A:
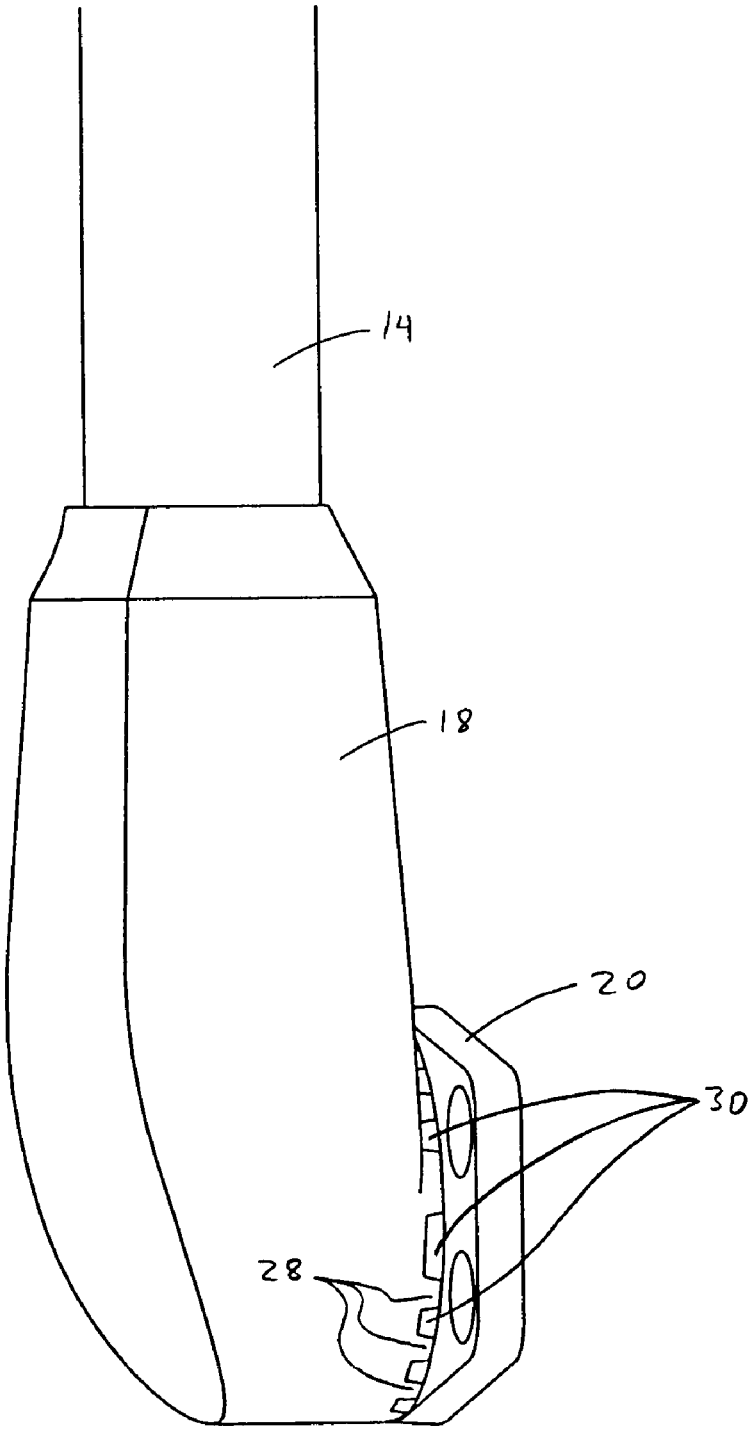
FIG. 4*a* is a pictorial view of the coupler and base of FIGS. 2 and 3 with teeth interlocked.

Viewing FIG. 4*b*, the teeth 28 and 30 preferably have tapered sides to provide for smooth engaging action when a locking position is reached. It will be apparent that the greatest possible rotational resistance will be obtained through the interlocking of angularly spaced, radial teeth having side surfaces which are vertical relative to the coupling face, not tapered. The interlock provided by non-tapered teeth is purely mechanical, and does not depend on friction because the interlocking side surfaces of the teeth are essentially perpendicular to the force of rotation. However, teeth with non-tapered sides only begin to interlock at exactly the locking angular position. Thus their locking action is not smooth, and may not be reliable due to manufacturing tolerances. To improve the operation of the leg locking mechanism, the inventors have found that providing a slight taper on the sides of the teeth, as shown in FIG. 4*b*, improves the ease and smoothness of operation. Because the top of each channel between teeth is wider than the bottom of the channel, and the top of each tooth is narrower than the base of the tooth, a larger opening with a sloped contact is provided, which eases the teeth into position slightly before the leg actually reaches the exact locking position. The teeth and valleys therebetween are also configured such that a gap remains in the bottom of the valley when a tooth is engaged. This prevents the teeth from bottoming-out, thus ensuring that full wedge force is attained between the tapered sides of the teeth.

Naturally, too much taper will increase reliance on frictional forces, and may also create wedge action which tends to push opposing teeth away from each other, thus tending toward disengagement. Through experimentation, the inventors have found that teeth having a taper $\alpha$ (FIG. 4*b*) of between 4° and 6°, are suitable. Preferably, the sides of the teeth are tapered at an angle $\alpha$ of about 5°, though other angles may be used. The inventors have found that tapers $\alpha$ of about 50° provide what is known as "taper lock." In this condition, the inherent frictional forces between the teeth overcome the wedge action and thus minimize the clamping force required to maintain engagement of the teeth. The inventors have found that tapers $\alpha$ above about 7° tend to undesirably reduce the strength of the engaged coupler.

The tapered sides of the teeth also minimize the effects of wear due to repeated usage over time. As the leg locking mechanism is used, the teeth may tend to deform slightly because of the large forces imposed upon them. This may cause an individual tooth or valley to change shape, possibly resulting in less than full contact between the teeth, and thus lower coupling strength and/or creating sloppiness in engagement. However, the tapered configuration of the teeth helps accommodate this deformation because the tapered sides are more likely to keep full contact even when deformed than are vertically-sided teeth.

Similarly, the tops 50 of the teeth may gradually wear down due to repeated sliding over each other, as indicated by the wear line 51 in FIG. 4*b*. This may make the fit of the teeth sloppy, causing the table to become wobbly. As mentioned above, the extra depth in the valleys 28 relative to the width of the teeth 30 allows the tapered sides of the teeth to fully wedge against each other without bottoming out, even after some uneven wear of the tops of the teeth.

Referring back to FIG. 1A, the engaging force which tends to keep the couplers and bases engaged may comprise a flexible compression rod 38 which is provided with passive hinges 40. The rod 38 is made of a flexible material such as fiberglass, and interconnects the table legs near oppositely oriented couplers 18 on opposing legs 14 of one leg assembly 12, pressing outward upon them to keep the teeth engaged. However, the passive (i.e. compliant) hinges 40 allow the rod 38 to be deflected at will, such that it buckles and allows the couplers to disengage under the force of the biasing means disposed between opposing circular faces 26 and 32. The user may then rotate the leg assembly 12 to a different position, whereupon the teeth of the couplers re-engage, and the compression rod 38 snaps back into its straight configuration.

Figure 1B:
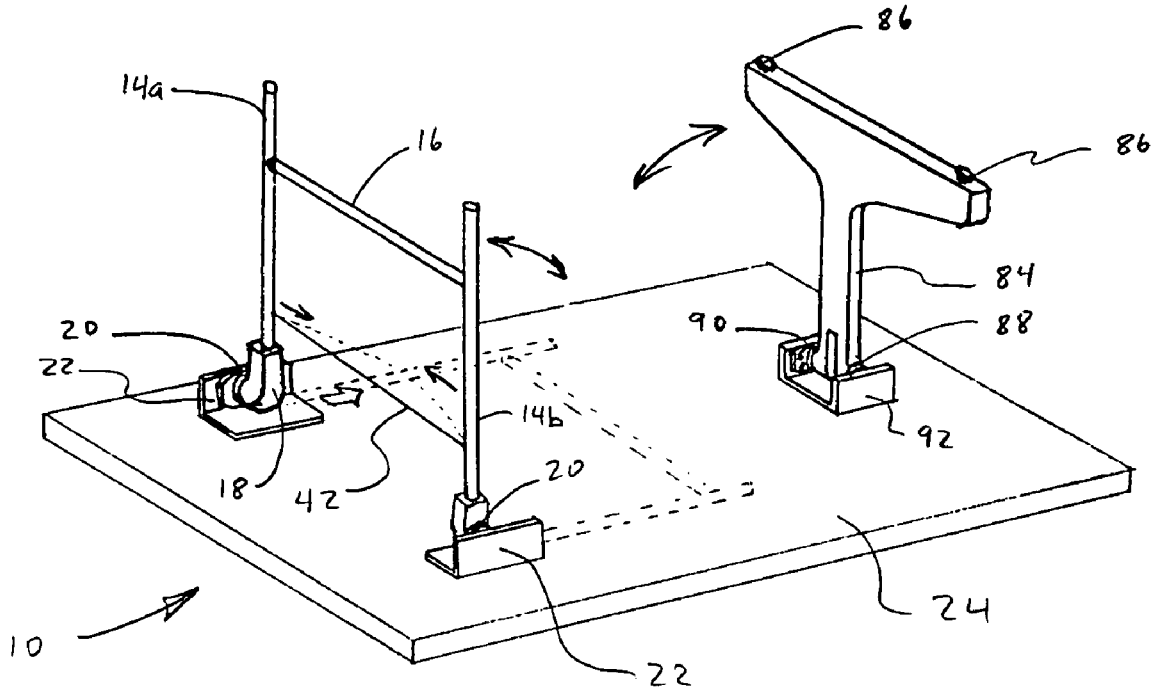
FIG. 1B is an underside view of the table of FIG. 1 wherein the selectively releasable engagement mechanism for the dual leg configuration includes a tension member deflecting mechanism.

Other methods for biasing the couplers and bases in the engaged position are also possible. For example, the table leg assembly 12 may be configured such that the legs 14 are attached to the crossbar 16 at a slight angle, such that the tops of the legs must be deflected inwardly to fit between the bases, thus providing a normally outwardly directed biasing force, which is released by deflecting the compression rod 38 or by pulling on a flexible tension member 42 connected therebetween, as shown in FIG. 1B. The tension member 42 may be a cable, a rope, or any other comparable element. It will be apparent that the opposing circular faces may be oppositely oriented from that shown, with the coupler faces oriented inward, and the base faces facing outward. Consequently, the inherent biasing force of the leg assembly 12 may be either inwardly or outwardly directed, as needed. Other engaging and releasing methods may also be employed, including the cam lock mechanism described in more detail below.

Figure 5:
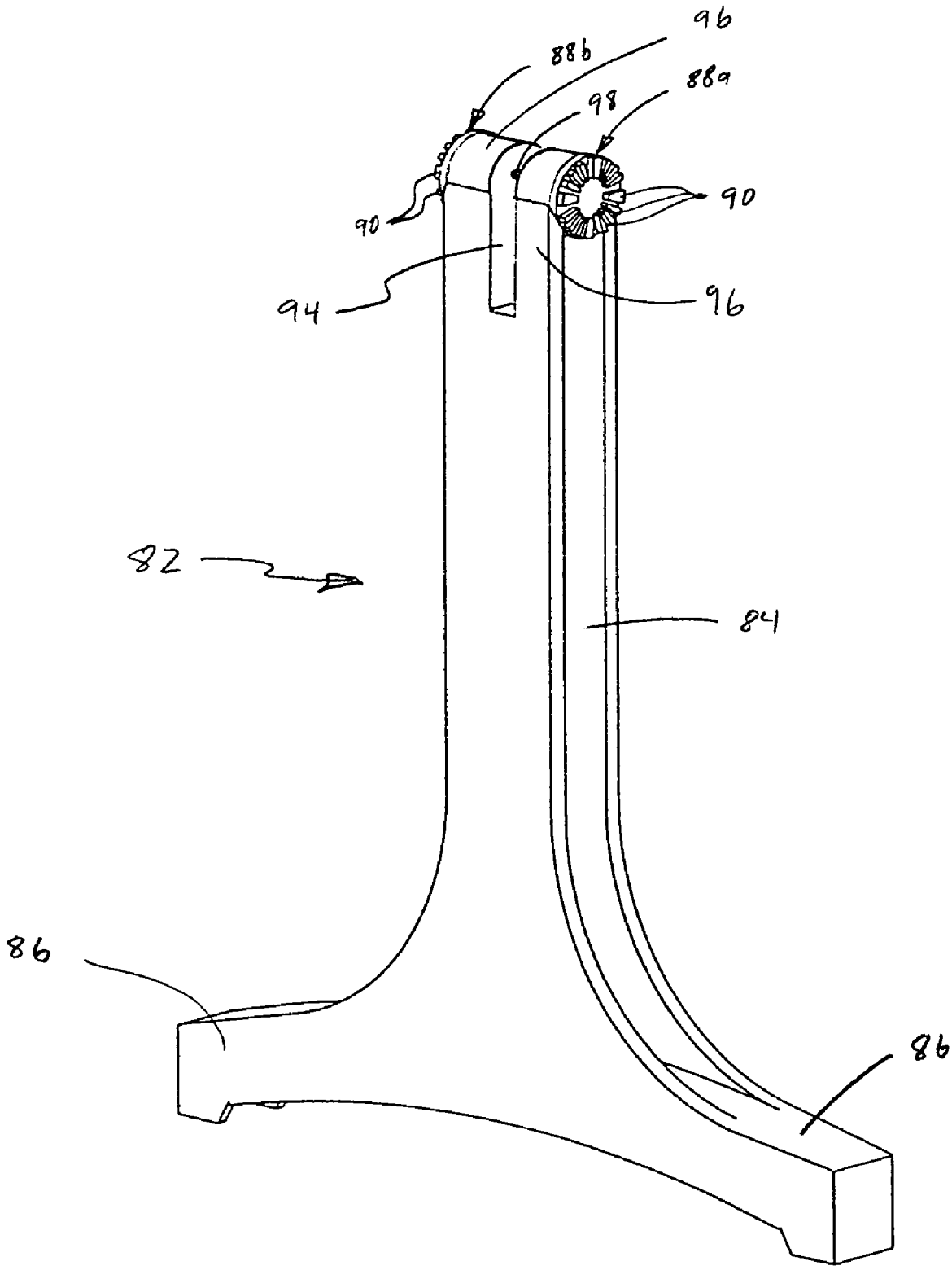
FIG. 5 depicts an alternative embodiment of a leg assembly comprising a single vertical leg member which diverges into two feet.

In an alternative embodiment, shown in FIG. 5, a leg assembly 82 may comprise a single vertical leg member 84 which diverges into two feet 86 for stability. The top of the leg 84 is provided with outwardly oriented circular faces 88*a* and 88*b*, which comprise a circular pattern of radial teeth 90. Referring to FIG. 1A, the teeth 90 are configured to engage with the teeth of oppositely oriented bases 20 like those described above, which are affixed to a mounting bracket 92 which is affixed to the underside 24 of the table 10.

At the top of the single vertical leg 84 is a vertical slot 94, forming forked ends 96. The slot allows the legs to deflect inwardly, allowing the teeth to disengage. In this embodiment, the forked ends 96 are formed to be biased away from each other, so as to provide the engaging force to engage the teeth of the oppositely oriented bases 20. A buckling rod 98 is disposed between the forked ends to allow a user to deflect the forked ends toward each other, allowing the biasing means to push the locking and counter-locking faces away from each other, allowing the leg to be rotated. Alternatively, a cam or toggle mechanism (not shown) could be provided in the slot 94 to perform the same function.

Referring now to FIGS. 6–11, in an alternative embodiment, a leg locking mechanism 100 in accordance with the invention may comprise a compact assembly wherein the mechanism for producing the biasing forces to engage and disengage the teeth does not rely upon the support legs. Viewing the exploded views of FIGS. 9*a* and 9*b*, this embodiment, like that of FIGS. 1–4, includes a base 102 and a coupler 104, and also comprises a cam cylinder 106, a spring washer 108, and a torsion spring 110.

Figure 11:
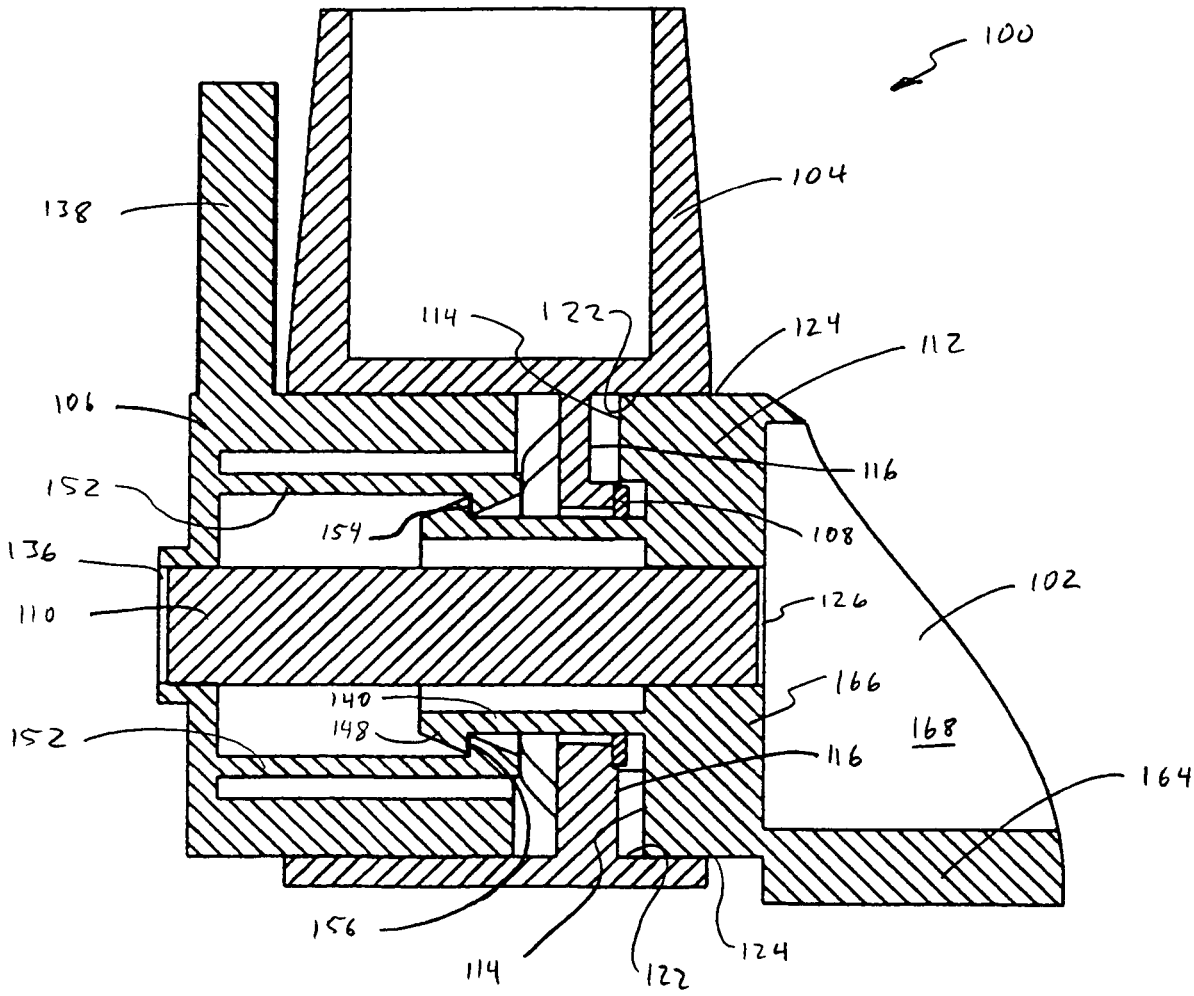
FIG. 11 is a cross-sectional view of the assembled leg locking mechanism with the teeth of the coupler and base disengaged, taken along line 11—11 in FIG. 10.

Disposed on the base 102 is a circular hub 112 (seen best in FIG. 9*a*), which carries a locking side having a plurality of radially spaced, flat-topped teeth 114, disposed in a ring around the center of the hub. The coupler 104 has a counter-locking side with a mating set of flat-topped teeth 116 (seen best in FIG. 9*b*) disposed in a ring around the center of a circular aperture 118. The radially spaced flat-topped teeth 114 and 116 are configured as described above. The teeth 116 and circular aperture 118 are disposed within a cylindrical depression 120 formed in one side of the coupler body. The depression 120 is configured to fit around the perimeter of the circular hub 112, so that the inner sides 122 of the depression slidingly mate with the outer sides 124 of the hub 112. The hub 112 thus both supports the coupler, and allows sliding rotation of the coupler on the base. The contacting surfaces of the inner sides of the depression and the outer sides of the hub are depicted in FIG. 11. The base 102 also includes a torsion spring recess 126, for receiving the torsion spring 110.

The invention advantageously incorporates a cam mechanism for biasing the counter-locking side of the coupler toward the locking side of the base, for engaging the teeth of the base and the coupler. Viewing FIG. 9*a*, the side of the coupler 104 opposite the counter-locking face includes a cam aperture 128 which is configured to slidingly receive the cam cylinder 106. Disposed within the cam aperture and located at its periphery are cam surfaces, specifically, a pair of curved cam ridges 130, with cam valleys 132 therebetween (only one of each of which are visible in FIG. 9*a*). The cam cylinder 106 likewise includes cam surfaces, specifically, a pair of cam lobes 134 on its forward edge (both of which are visible in FIG. 9*b*), and also includes a torsion spring recess 136, and a release lever 138. The cam cylinder is configured to be inserted into the cam aperture with the cam lobes disposed against the cam ridges of the coupler, and the torsion spring affixed in the torsion spring recess.

Returning to FIGS. 9*a* and 9*b*, protruding from the center of the hub 112 are a first set of resilient interlocking tabs 140 arranged in an annular configuration, concentric with the angularly spaced, radial teeth 114. These tabs perform two primary functions. First, the base 142 of the tabs forms a circular shaft or axle about which the spring washer 108 is placed. The spring washer 108 is configured to abut against an inner portion 144 of the locking side of the base 102, and an inner rim 146 of the aperture 118 of the coupler, for biasing the counter-locking side of the coupler away from the locking side of the base, to allow disengagement of the teeth of the base and the coupler.

The first interlocking tabs 140 have outwardly directed interlocking bevels 148 at their distal extremity. These outwardly directed bevels are configured to deflect and slide past a corresponding set of inwardly directed interlocking bevels 150 disposed at the ends of a second annular set of interlocking tabs 152 connected to the cam cylinder 106. The interlocking tabs 140 and 152 include oppositely oriented vertical locking faces 154 and 156, respectively. Because the tabs are resilient, and the diameters of their respective annular groupings are complementary, the oppositely oriented bevels push the tabs apart when the sets of tabs are pushed together, allowing the ends of the tabs to slide past one another, then snap back to their original position, engaging the locking faces. Additionally, the tabs 140 are different sizes (i.e. different widths measured radially) from the tabs 152 to prevent catching during rotation. This ensures that there is engagement of the locking faces of the tabs around the full perimeter at all times during rotation, yet helps prevent the edges of tabs from catching on each other because the edges of tabs are only encountered one at a time during rotation. The interlocking tabs thus lock with each other, yet allow sliding movement (i.e. rotation of the cam cylinder relative to the base) when pressed against each other. The engaged locking faces 154 and 156 of the interlocking tabs are shown in FIG. 11. This configuration allows easy assembly of the leg locking mechanism, and once assembled, allows free rotation of the interconnected parts, while providing a mechanism for transmitting lateral force from the cam cylinder into the base.

To assemble the leg locking mechanism, the spring washer 108 is placed over the first set of interlocking tabs 140, and pushed toward the base 142 of the first interlocking tabs, such that it is roughly against the inner portion 144 of the locking side of the base. The 118 aperture of the coupler 104 is then aligned with the first interlocking tabs, and the coupler is slid into place with its counter locking side disposed near the locking side of the base, and the inner side 122 of the depression slidingly mated with the outer side 124 of the hub 112. The torsion spring 110 may then be inserted through the coupler aperture 118, and into the torsion spring recess 126 in the base. To hold the coupler in place, the cam cylinder 106 is inserted into the cam aperture 128, with the cam cylinder cam lobes 134 disposed toward the cam ridges 130 of the coupler and the torsion spring aligned with the cam cylinder torsion spring recess, until the second interlocking tabs 152 slide past and engage the first interlocking tabs 140.

Once assembled in this way, the torsion spring tends to hold the cam cylinder in a position wherein its cam lobes press against the cam ridges of the coupler, so that the teeth of the coupler and base will be engaged. The elongate torsion spring 110 is disposed with its long axis substantially coincident with the axis of rotation of the folding leg, and, being affixed at one end to the base and at the other end to the cam cylinder, resists rotation of the cam cylinder. The torsion spring may comprise a solid elongate piece of elastomeric material, such as polyurethane, extruded thermoplastic rubber, or other resilient materials. One suitable material for the torsion spring is Santoprene™, manufactured by Advanced Elastomers of Akron, Ohio. It will be apparent to one skilled in the art, however, that many other suitable configurations and materials for the torsion spring could be conceived for providing the same function. For example, the torsion spring could be a coil spring, and could be formed of metal.

Figure 9A:
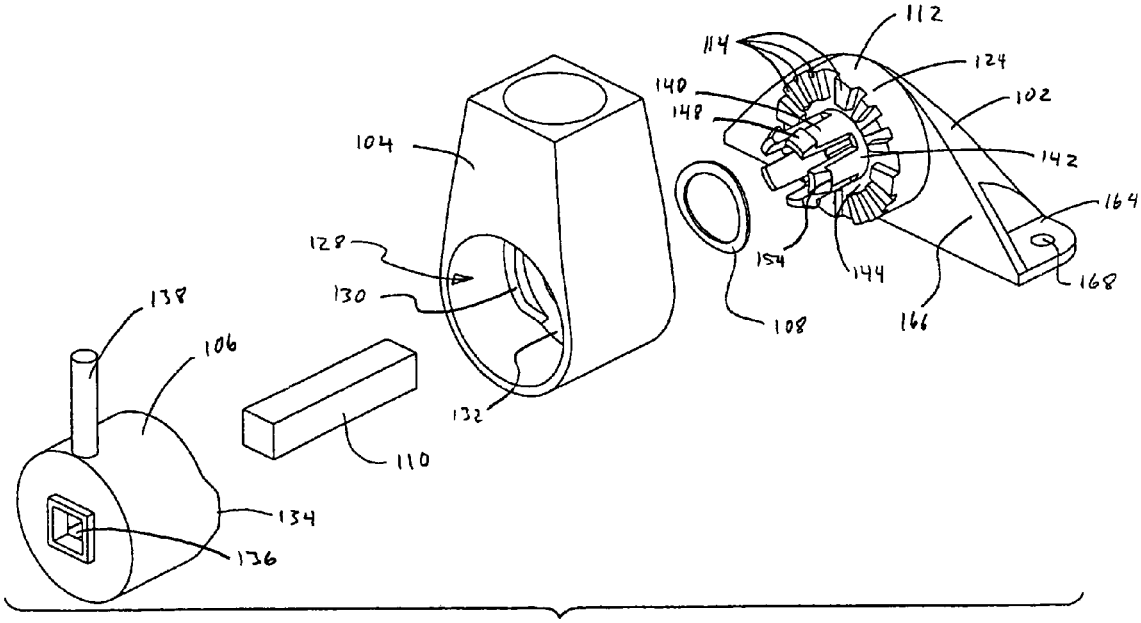
FIG. 9*a* is an exploded pictorial view of the leg locking mechanism of FIG. 8*a*.
Figure 9B:
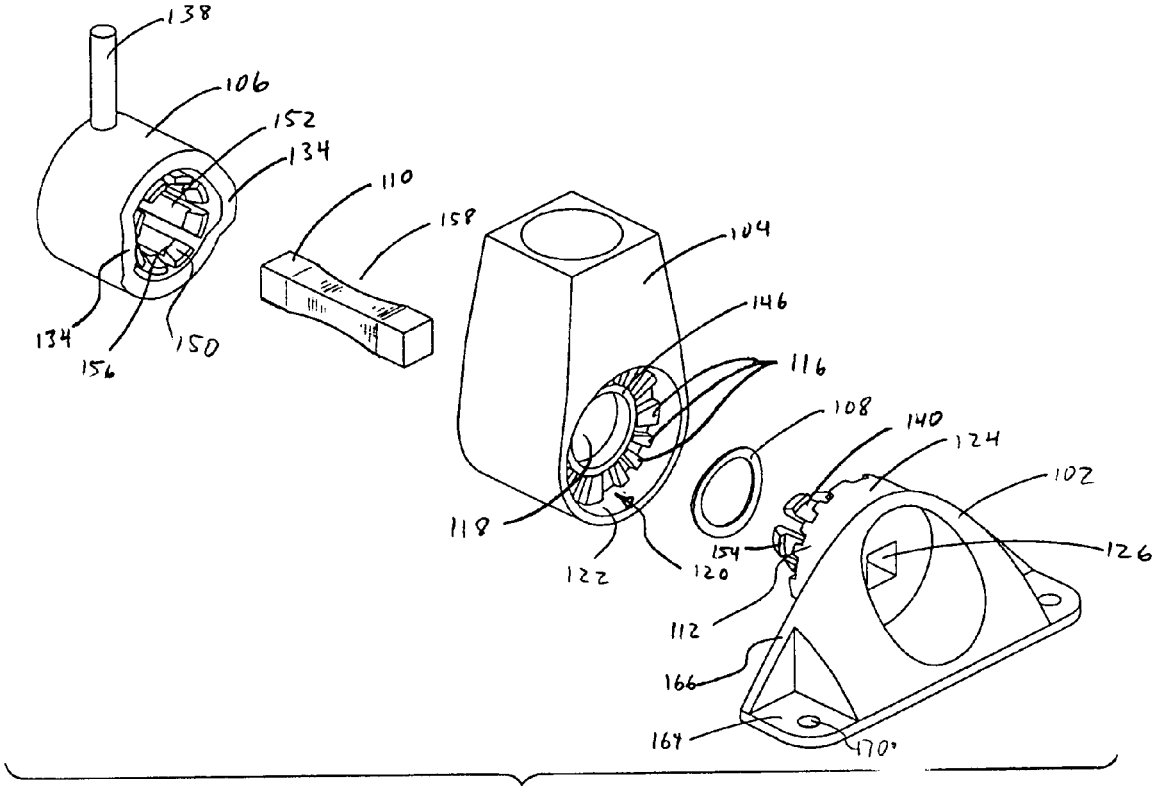
FIG. 9*b* is an exploded pictorial view of the leg locking mechanism of FIG. 9*a*, from an opposite vantage point.
Figure 10:
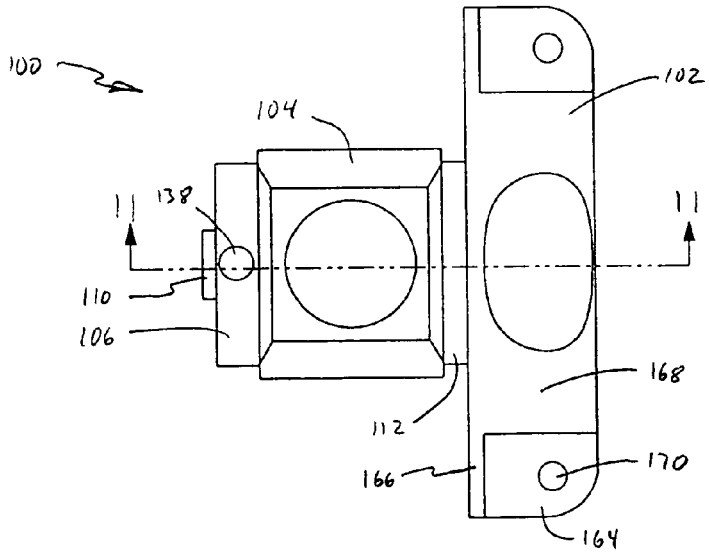
FIG. 10 is a top view of the assembled leg locking mechanism of FIG. 8*a*.

The torsion spring 110 may be prismatic in shape, having a constant cross-section, as shown in FIG. 9*a*, though it may have a cross-sectional shape other than rectangular, such as circular, octagonal, etc. Alternatively, the torsion spring may be configured with a reduced cross-section middle portion 158 as shown in FIG. 9*b*. This configuration may be desirable to allow more accurate manipulation and control of the torsional strength of the elongate piece. For example, different materials or different batches of the same material may have different material properties, requiring modification of the shape of the torsion spring to achieve the desired performance when all other aspects of the leg locking mechanism remain the same.

The torsion spring 110 is configured to hold the cam cylinder 106 with its cam surfaces engaged against the cam surfaces of the coupler, and thereby keep the flat-topped teeth 114 and 116 engaged, with sufficient force to overcome the oppositely directed force of the spring washer 108. To disengage the teeth, a user rotates the cam cylinder against the force of the torsion spring by pushing the release lever 138, to rotate the cam lobes into alignment with the cam valleys 132 of the coupler. This releases lateral force on the coupler, allowing the spring washer to push the coupler away from the base, thus separating the locking and counter-locking faces of the base and coupler, respectively, allowing free rotation of one relative to the other. The operation of the spring washer and the releasable cam cylinder thus create a selectively releasable engagement mechanism configured for selectively locking the leg in an extended position and a folded position, or any other desired position, depending on the configuration of the teeth.

Once the teeth disengage, the flat-topped teeth of the base and coupler may slide over one another as the leg is rotated, as described above, until the teeth reach a subsequent interlocking position. After releasing the teeth and beginning rotation, the user may let go of the release lever, allowing the cam to rotate with the coupler, until reaching the subsequent interlocking position. At that point, under the force of the torsion spring, the cam cylinder will tend to rotate back to a position in which the cam lobes of the cam cylinder press against the cam ridges of the coupler, thus pushing the coupler 104 toward the base 102 and engaging the teeth. The torsion spring also provides the added benefit of providing slight resistance to rotation of the leg, which gives the leg locking mechanism a feel of strength and quality, and may also prevent injury during its use, such as from sudden unexpected motion, etc.

Figure 8A:
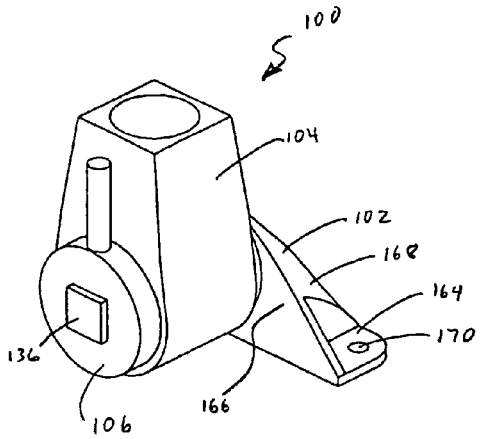
FIG. 8*a* is a pictorial view of one embodiment of a leg locking mechanism shown in FIG. 6, fully assembled.
Figure 8B:
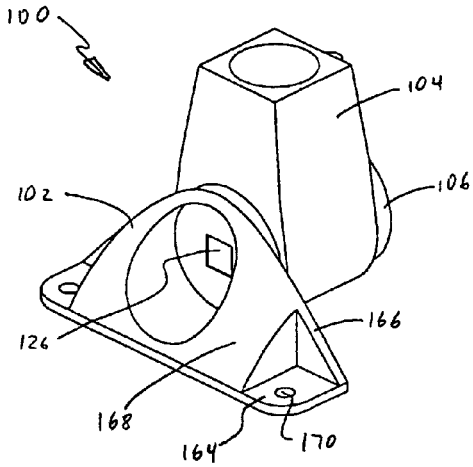
FIG. 8*b* is a pictorial view of the leg locking mechanism of FIG. 8*a*, from an opposite vantage point.

In an alternative embodiment, the torsion spring 110 may be inserted after the cam cylinder 106 is put into place, depending upon the configuration of the torsion spring recesses 126 and 136. For example, as shown in FIGS. 9*a* and 9*b*, the torsion spring recesses in either or both of the cam cylinder and base may be open ended, thus allowing insertion of the torsion spring through the cam cylinder torsion spring recess 136 and into the base torsion spring recess 126 after assembly of the other components of the leg locking mechanism. Once inserted, the torsion spring may be affixed in place in the respective recesses with a suitable adhesive, cross pin, or wedge. However, as shown in FIGS. 8*a* and 8*b*, the cam cylinder 106 and/or base 102 may have a closed torsion spring recess, which requires that the torsion spring be inserted and affixed in its recess during assembly of the locking mechanism components. This latter configuration provides a cleaner appearance of the mechanism, and may also help prevent damage to the torsion spring during use. Moreover, in this manner the torsion spring can be placed in slight axial compression, thus ensuring that its deformation during use remains in the elastic range for the material selected. Slight axial compression of the torsion spring also helps keep all of the parts snug and rattle-free.

Figure 6:
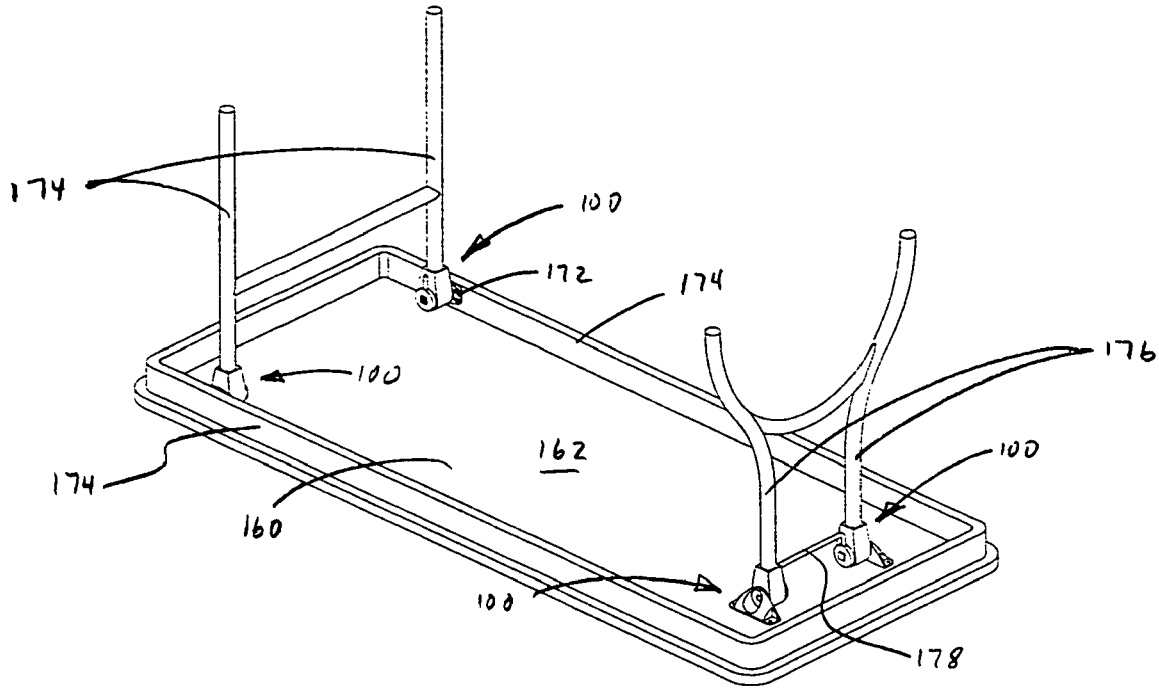
FIG. 6 is an underside pictorial view of a table provided with another embodiment of a leg locking mechanism according to the present invention, showing two different base attachment configurations, and two different connected leg configurations.
Figure 7:
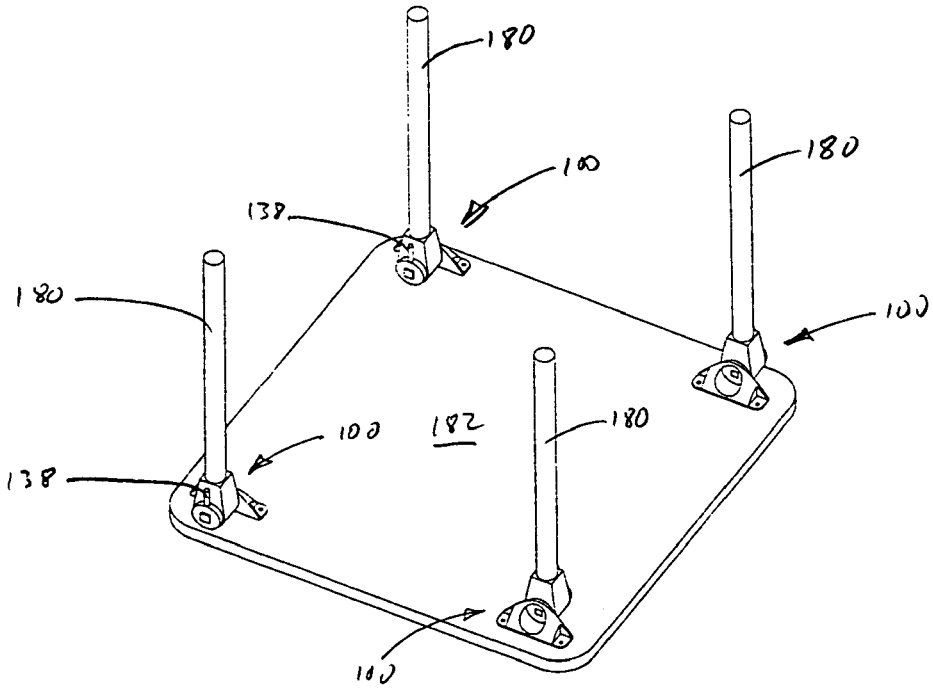
FIG. 7 is an underside pictorial view of a table provided with one embodiment of the leg locking mechanism of FIG. 6, associated with four independent legs.

Viewing FIGS. 6 and 7, the leg locking mechanism 100 may be configured to mount directly to the underside 160 of a table 162 or other support surface, as shown in the lower right side of FIG. 6, and in FIG. 7. Viewing FIGS. 8*a* and 8*b*, for example, the base 102 may be a unitary piece comprising a table mounting face 164 which is configured to connect to the underside of the table, and a coupler mounting face 166 which is substantially perpendicular thereto, and carries the circular hub and locking side with its angularly spaced, radial teeth. Other structure may also be associated with the base, such as strengthening ribs 168 and holes 170 for screws, bolts, or other mounting hardware.

Alternatively, referring to the upper left side of FIG. 6, the leg locking mechanism 100*a* may be configured with a side-mounting base 172 (similar to the base 20 depicted in FIGS. 1–4). In this configuration, the base comprises a single mounting plate, which corresponds to the coupler mounting plate, and mounts to the table or other support surface. The locking side with its angularly spaced, radial teeth and related structure are carried on one side of the mounting plate, and the other side is affixed to a table runner 174 or comparable structure, rather than directly to the underside of the table or other support surface.

Viewing FIGS. 6 and 7, it will be apparent that the leg locking mechanism of the present invention may be used with a variety of types and styles of tables, and a variety of leg types and configurations. For example, as shown at the upper left in FIG. 6, a pair of independent leg locking mechanisms may be associated with each of a pair of interconnected legs 174. This configuration requires users to separately disengage each leg locking mechanism when it is desired to rotate the pair of legs to the folded position. Alternatively, as shown at the lower right of FIG. 6, the release levers 138 of two connected legs may be connected with a release bar 178, allowing a user to release both leg locking mechanisms with one action. As yet another alternative, shown in FIG. 7, each independent leg locking mechanism may be associated with a single table leg 180, such as on each of the legs of a small card-type table 182.

The individual parts of the leg locking mechanism may be formed of a variety of materials. It is desirable that the parts be strong and tough, yet lightweight, abrasion resistant, and dimensionally stable. Inherent lubricity is also desirable for slidingly engaged parts. Materials which the inventors have found to be suitable include injection molded polymers, such as acetal plastic (particularly for the cam cylinder) and glass-filled polypropylene (particularly for the coupler). Other parts, such as the spring washer 108 and the base 102 may be made of metal.

As described, the invention thus comprises a two-position mating lock which is attached to a table and a leg, and is configured for selectively locking the leg in an extended position and a folded position. The lock has a biasing member configured for biasing the mating lock in a disengaged position, and a selectively releasable spring member configured for biasing the mating lock in an engaged position, with the selectively releasable spring member providing a force greater than the disengaging force of the biasing member.

Referring now to FIGS. 12–15, in an alternative embodiment, a compact leg locking mechanism 200 in accordance with the present invention may be configured with interlocking teeth 214, 216 of uniform size and spacing. The inventors have found that where interlocking teeth of non-uniform width are used, the rotational strength of the compact leg-locking mechanism when locked is dictated by the width of the smallest tooth. Consequently, the greatest locking strength is possible when the teeth are uniform in width.

The embodiment of FIGS. 12–15 is largely similar to that of FIGS. 8–9. As with the previous embodiment, it may be mounted to a table or other support surface in various ways, and may be used with a variety of types and styles of legs and tables, as discussed above with respect to FIGS. 6 and 7. This embodiment includes a base 202, a coupler 204, a cam cylinder 206, a spring washer 208, and a torsion spring 210. The base 202 includes a circular hub 212, which carries a locking side having a plurality of radially spaced, flat-topped teeth 214, disposed in a ring around the center of the hub. The base also includes a table mounting face 264 and a coupler mounting face 266 that is substantially perpendicular thereto. The base may also include strengthening ribs and holes 270 for mounting hardware.

The coupler 204 has a counter-locking side with a set of flat-topped teeth, generally designated at 216, disposed in a ring around the center of a circular aperture 218 and configured to mate with the teeth 214 of the base. These radially spaced flat-topped teeth are generally configured as described above, with a few exceptions as noted below. As with the embodiment of FIGS. 8 and 9, the teeth and circular aperture 218 are disposed within a cylindrical depression 220 formed in one side of the coupler body, which fits around the circular hub 212, so that the inner side 222 of the depression can rotationally slide on the outer side 224 of the circular hub. The base 202 also includes a torsion spring recess 226, for receiving the torsion spring 210.

The coupler 204 includes a cam aperture 228 which is configured to slidingly receive a cam cylinder 206. Disposed within the cam aperture and located at its periphery are a pair of curved cam ridges 230, with cam valleys 232 therebetween (only one of each of which are visible in FIG. 12). The cam cylinder 206 includes corresponding cam lobes 234 on its forward edge, and a torsion spring recess 236.

Protruding from the center of the hub 212 are a set of resilient interlocking tabs 240 arranged in an annular configuration, concentric with the angularly spaced, radial teeth 214. The base 242 of the tabs forms a circular shaft or axle about which the spring washer 208 is placed. The spring washer abuts against an inner portion 244 of the locking side of the base 202, and against an inner rim 246 of the aperture 218 of the coupler, as described above.

The interlocking tabs 240 have outwardly directed interlocking bevels 248 at their distal extremity, which are configured to deflect and slide past a corresponding set of inwardly directed interlocking bevels 250 disposed in the cam cylinder 206. The interlocking bevels push the interlocking tabs 240 inwardly when they are pushed into the cam cylinder, allowing the ends of the tabs to engage the inwardly directed interlocking bevels.

Figure 12:
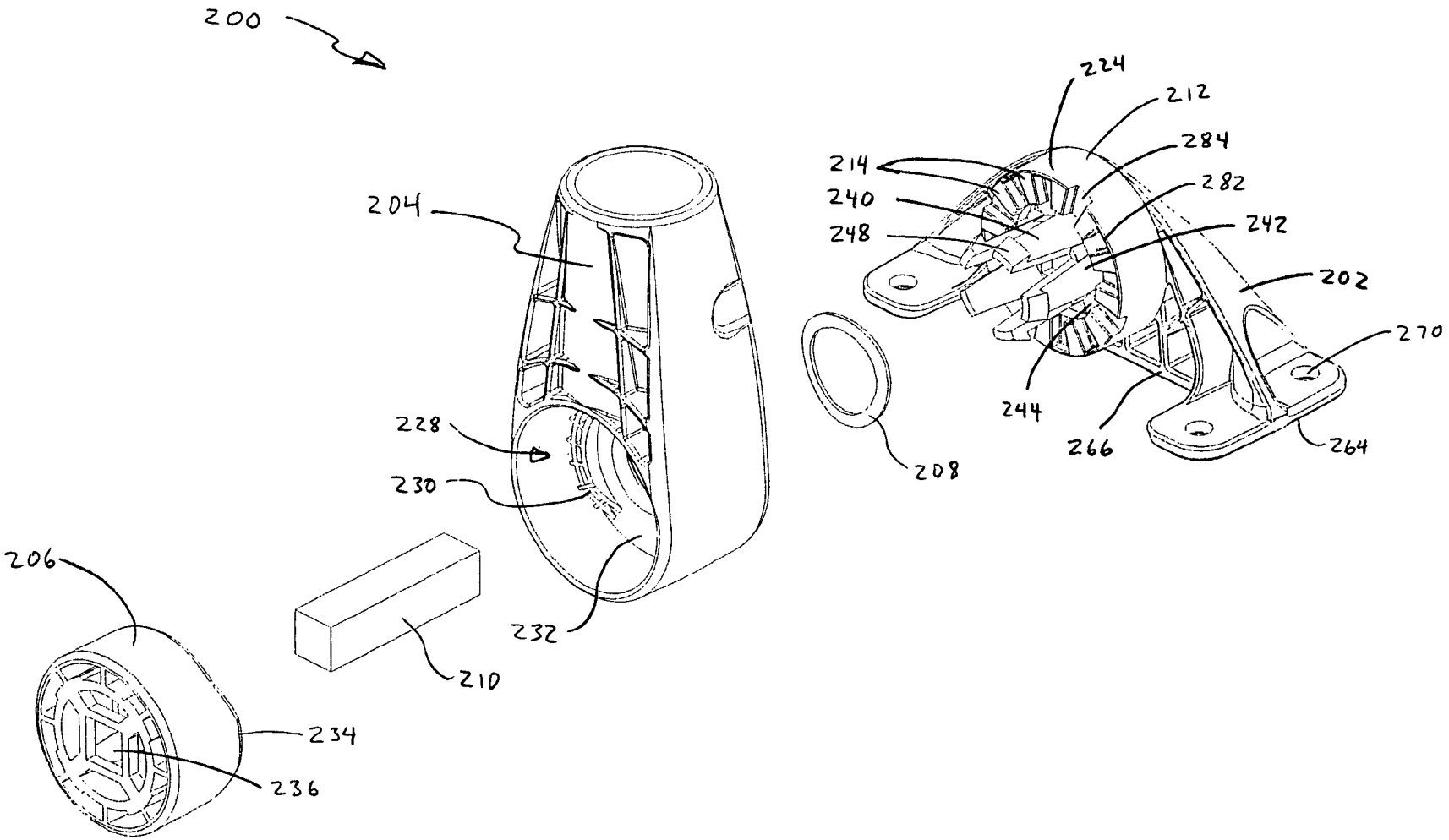
FIG. 12 is an exploded pictorial view of an alternative leg locking mechanism according to the present invention, wherein the coupler comprises teeth of uniform width and spacing.
Figure 13:
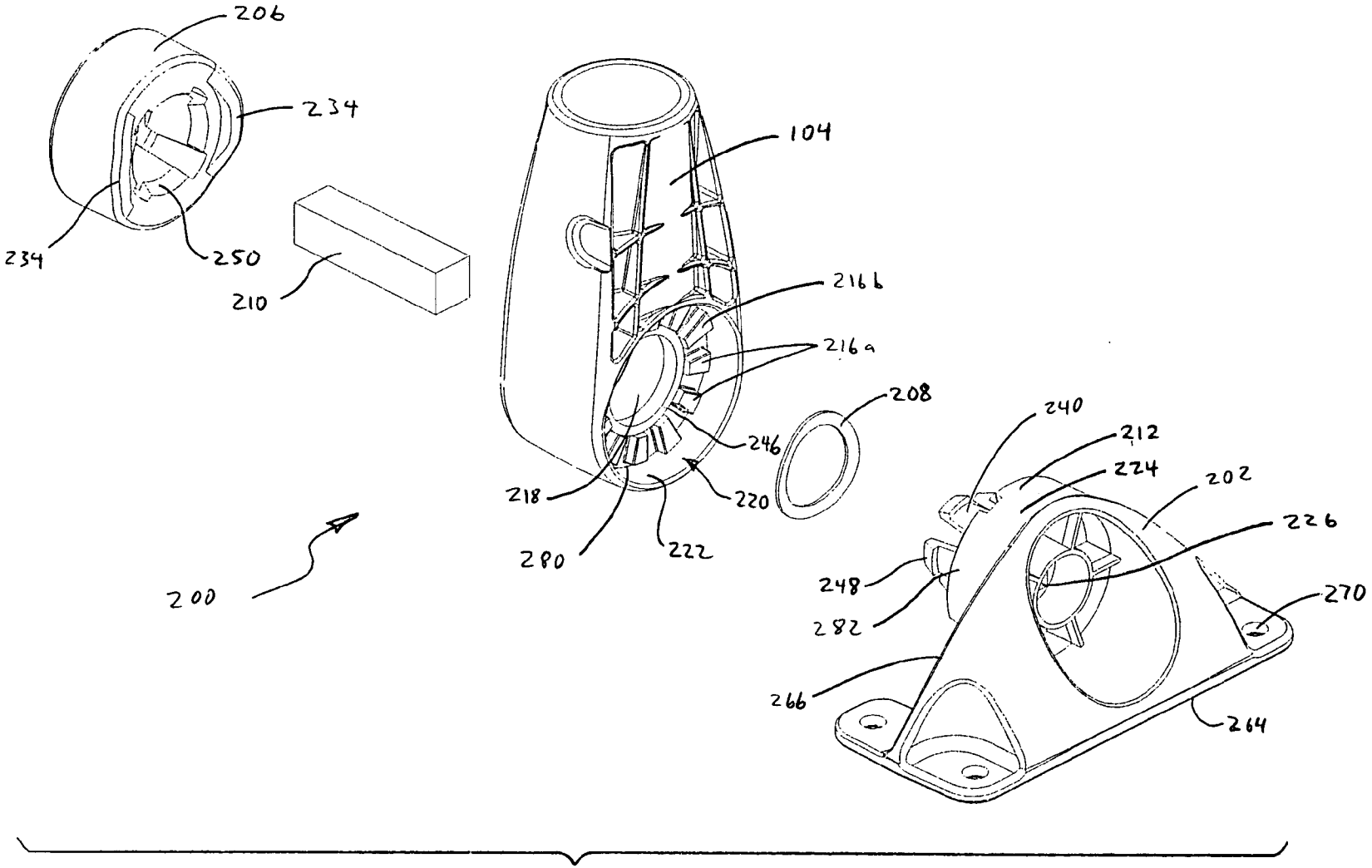
FIG. 13 is an exploded pictorial view of the leg locking mechanism of FIG. 12, from an opposite vantage point.
Figure 14:
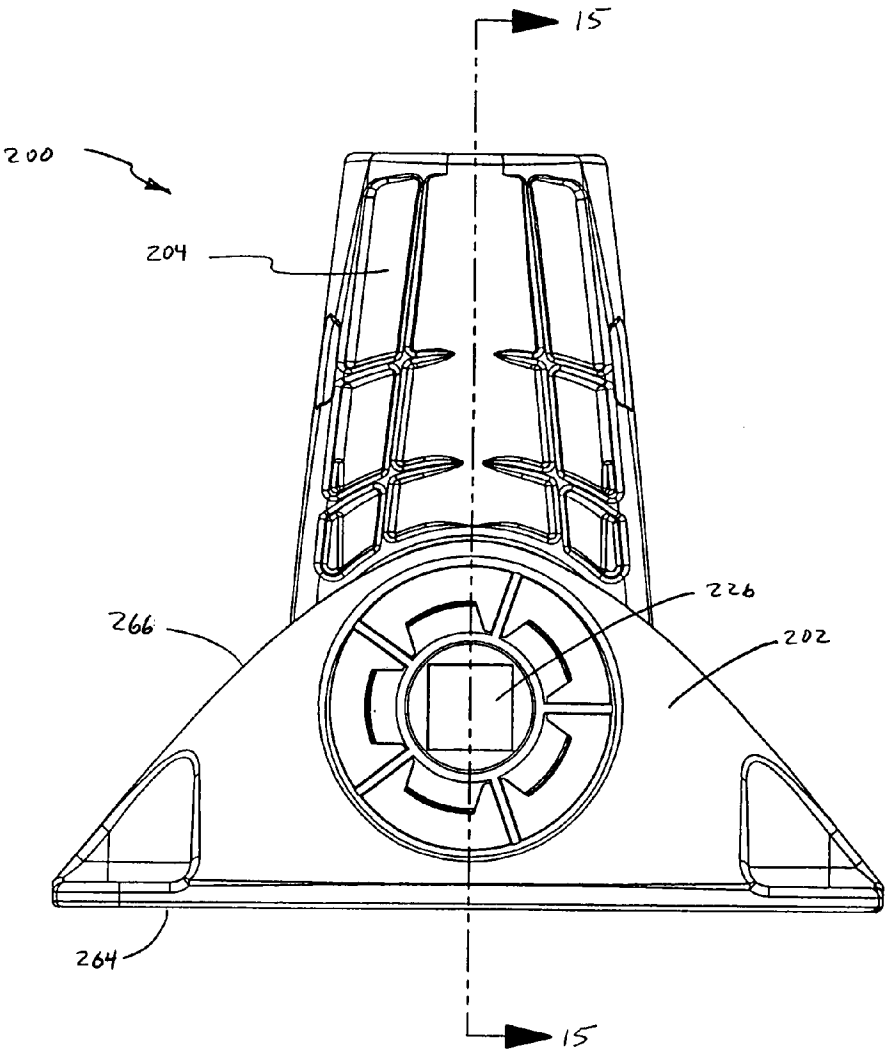
FIG. 14 is a side view of the assembled leg locking mechanism of FIG. 12.
Figure 15:
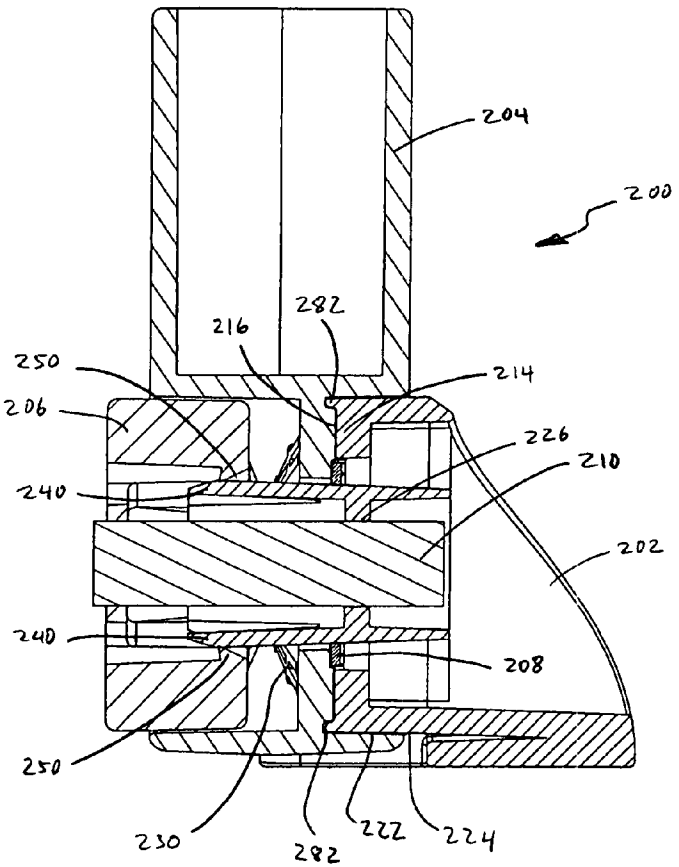
FIG. 15 is a cross-sectional view of the assembled leg locking mechanism of FIG. 14, taken along line 15—15 in FIG. 14.

As with the other embodiments described above, the interlocking tabs 240 may be configured with radial widths that are different than the radial width of the interlocking bevels 250, so as to promote smooth rotation. One way of doing this is to provide different numbers of interlocking bevels on the base 202 and cam cylinder 206, respectively. For example, the embodiment depicted in FIGS. 12 and 13 provides five interlocking tabs 240 on the base, and four interlocking bevels 250 in the cam cylinder. These features help ensure that there is strong engagement of the locking faces of the tabs around the full perimeter at all times during rotation, yet promote smooth rotation, as noted above.

The leg locking mechanism depicted in FIGS. 12 and 13 is assembled similarly to that of FIGS. 8–9, and operates in largely the same way. However, this embodiment provides a few different features that allow it to operate with the uniform-width teeth described above. It will be apparent that, with interlocking teeth of uniform width, the teeth will tend to interlock at each location corresponding to the angular spacing of the teeth, unless some other structure is provided. For this reason, the teeth 216 disposed in the coupler 202 have two different configurations. While all the teeth have the same width measured around the circle, certain long teeth 216*b* extend from the inner rim 246 to the inner side 222 of the cylindrical depression 220, while the rest of the teeth 216*a* are shorter, and do not connect to the inner side. Because of this configuration, a discontinuous annular glide ring slot 280 is created between the outer extremity of the shorter teeth 216*a* and the inner side 222 of the coupler.

The glide ring slot 280 corresponds to a discontinuous glide ring 282 disposed around the perimeter of the circular hub 212 of the base 202. The glide ring interconnects the outer extremity of discrete groups of the radially spaced teeth 214 of the base around the perimeter of the hub, but leaves a tooth gap 284 corresponding to the location of each long tooth 216*b* of the coupler. When the teeth are disengaged and the coupler and base are rotated with respect to each other, the glide ring rides upon the flat top surfaces of the long teeth until it reaches the next location where the long teeth can slide into the tooth gap, allowing all teeth to interlock.

In the embodiment shown in FIGS. 12 and 13, the long teeth 216*a* and the tooth gaps 284 are disposed every 90° around the circle to allow the leg locking mechanism to engage at positions separated by 90° from each other. It will be apparent that the invention may be configured with interlocking positions at different angular spacings. As with the previously-described embodiments, this configuration creates a selectively releasable engagement mechanism, but provides greater rotational strength because all of the teeth have a uniform width.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A locking mechanism for a support leg hingedly attached to a support surface and rotatable between an extended position and a folded position, comprising:

a base, configured for attaching to the support surface, the base having a plurality of angularly spaced, radial teeth, and a discontinuous circular glide ring disposed about a perimeter of the radial teeth;

a coupler, disposed at an end of the support leg, having a plurality of angularly spaced, radial teeth, and a discontinuous annular glide ring slot disposed about a perimeter of the radial teeth, the teeth and glide ring of the base being configured to mate with the teeth and glide ring slot of the coupler; and a selectively releasable engagement mechanism, configured to engage and disengage the base with the coupler.

2. The locking mechanism of claim 1, wherein the teeth of the base and the teeth of the coupler are flat-topped to allow smooth sliding contact during rotation of the support leg between the extended position and the folded position.

3. The locking mechanism of claim 2, further comprising:

a hub, disposed on the base, the plurality of teeth of the base and the glide ring being disposed on the hub;

a socket, disposed in the coupler, configured to slidably receive the hub, and having an outer socket wall, the plurality of teeth of the coupler and the glide ring slot being disposed in the socket;

wherein at least two of the plurality of teeth of the coupler have a distal end connected to the outer socket wall; and wherein the discontinuity of the glide ring comprises at least two tooth gaps configured to align with and receive the distal ends of the at least two teeth when the coupler is engaged with the base, and the glide ring is configured to slide upon the flat tops of the at least two teeth when the coupler is disengaged and rotated with respect to the base.

4. The locking mechanism of claim 3, wherein the at least two teeth of the coupler and the at least two tooth gaps of the base are separated by about 90° from each other.

5. The locking mechanism of claim 3, wherein the at least two teeth of the coupler comprise four teeth, and the at least two tooth gaps of the base comprise four tooth gaps.

6. The locking mechanism of claim 1, wherein the teeth are uniform in width.

7. The locking mechanism of claim 1, wherein the teeth are non-uniform in width.

8. The locking mechanism of claim 1, wherein the base and the coupler are configured for interlocking engagement with each other only at selected angular positions.

9. The locking mechanism of claim 8, wherein the selected angular positions include the leg (i) in an extended position substantially perpendicular to the support surface, and (ii) in a folded position substantially parallel to the support surface.

10. The locking mechanism of claim 1, further comprising a biasing member, configured to bias the teeth of the base away from the teeth of the coupler when the engagement mechanism is disengaged.

11. The locking mechanism of claim 1, wherein the selectively releasable engagement mechanism comprises:

a biasing spring, configured to bias the coupler away from the base, to encourage disengagement of the teeth of the base and the coupler;

a cam mechanism, associated with the coupler, configured to bias the coupler toward the base, to encourage engagement of the teeth of the base and the coupler, the biasing force of the cam being greater than the biasing force of the biasing spring; and a release, configured to release at least part of the biasing force of the cam, to allow the biasing spring to disengage the teeth of the base and the coupler, and allow rotation of the support leg relative to the base.

12. The locking mechanism of claim 11, wherein the cam mechanism further comprises:

a first cam surface, disposed on the coupler;

a cam cylinder, having a second cam surface, the second cam surface being in rotatable sliding engagement with the first cam surface of the coupler, having a first rotational position wherein the first and second cam surfaces are engaged, and a second rotational position wherein the first and second cam surfaces are disengaged; and a torsion spring configured to bias the cam cylinder toward the first position.

13. The locking mechanism of claim 12, wherein the release comprises a release lever connected to the cam cylinder, configured to allow a user to rotate the cam cylinder from the first position to the second position.

14. The locking mechanism of claim 12, wherein the torsion spring comprises a piece of resilient material having a first end, a second end, and an elongate axis, the resilient material being affixed at the first end to the base and at the second end to the cam cylinder, the elongate axis being substantially coincident with an axis of rotation of the support leg.

15. The locking mechanism of claim 12, further comprising a first plurality of rotational tabs associated with the cam cylinder, and a second plurality of rotational tabs associated with the base, the rotational tabs being configured to slidingly interlock with each other, such that the socket of the coupler is slidingly retained upon the hub of the base when the teeth of the base and coupler are disengaged.

16. The locking mechanism of claim 15, wherein the number of rotational tabs in the first plurality is different from the number of rotational tabs in the second plurality, so as to enhance smooth sliding contact of the rotational tabs.

17. A locking mechanism for a folding leg hingedly attached to a support surface, comprising:

a multi-position mating lock, attached to the support surface and the leg, configured for selectively locking the folding leg in an extended position and a folded position;

a biasing member, configured to bias the mating lock toward a disengaged position; and a selectively releasable cam mechanism, configured to bias the mating lock toward an engaged position, providing a force greater than a disengaging force of the biasing member.

18. The locking mechanism of claim 17, wherein the selectively releasable cam mechanism further comprises:

slidably mated cam surfaces, associated with the mating lock, having an engaged position and a disengaged position;

an elongate torsion spring, disposed substantially coincident with an axis of rotation of the folding leg, configured to bias the slidably mated cam surfaces toward the engaged position; and a release lever configured to allow selective rotation of the slidably mated cam surfaces into the disengaged position.

19. The locking mechanism of claim 17, wherein the multi-position mating lock further comprises:

a base, having a plurality of angularly spaced, radial teeth, and a discontinuous circular glide ring disposed about a perimeter of the radial teeth; and a coupler, having a plurality of angularly spaced, radial teeth, and a discontinuous annular glide ring slot disposed about a perimeter of the radial teeth, the teeth and glide ring of the base being configured to mate with the teeth and glide ring slot of the coupler in the extended position and in the folded position.

20. The locking mechanism of claim 19, wherein the teeth of the base and the teeth of the coupler are uniform in width.

21. The locking mechanism of claim 19, wherein the teeth of the base and the teeth of the coupler have tapered side faces.

22. A leg-locking mechanism, comprising:

a support leg, hingedly coupled to a support surface and rotatable between an extended position and a folded position;

a base, attached to the support surface, having a plurality of angularly spaced, radial teeth, and a discontinuous circular glide ring disposed about a perimeter of the radial teeth;

a coupler, disposed at an end of the support leg, having a plurality of angularly spaced, radial teeth, and a discontinuous annular glide ring slot disposed about a perimeter of the radial teeth, the teeth and glide ring of the base being configured to mate with the teeth and glide ring slot of the coupler when the support leg is in the extended position and in the folded position; and a selectively releasable engagement mechanism, configured to engage and disengage the teeth of the base with the teeth of the coupler.

* * * * *